US009749745B2

(12) United States Patent
Chen et al.

(10) Patent No.: US 9,749,745 B2
(45) **Date of Patent: *Aug. 29, 2017**

(54) LOW NOISE DIFFERENTIAL MICROPHONE ARRAYS

(71) Applicant: Northwestern Polytechnical University, Xi'an, Shanxi OT (CN)

(72) Inventors: Jingdong Chen, Shanxi (CN); Jacob Benesty, Montreal (CA)

(73) Assignee: Northwestern Polytechnical University, Shanxi (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/980,802

(22) Filed: Dec. 28, 2015

(65) Prior Publication Data

US 2016/0134969 A1 May 12, 2016

Related U.S. Application Data

(63) Continuation of application No. 13/816,430, filed as application No. PCT/CN2012/085830 on Dec. 4, 2012, now Pat. No. 9,237,391.

(51) Int. Cl.
*H04R 3/00* (2006.01)
*H04R 3/04* (2006.01)
(Continued)

(52) U.S. Cl.
CPC ..... *H04R 3/04* (2013.01); *H04R 1/08* (2013.01); *H04R 1/406* (2013.01); *H04R 3/005* (2013.01);
(Continued)

(58) Field of Classification Search
CPC ..... H04R 25/30; H04R 25/00; H04R 25/01; H04R 29/00; H04R 5/02; H04R 29/005;
(Continued)

(56) References Cited

U.S. PATENT DOCUMENTS 5,473,701 A * 12/1995 Cezanne ..... H04R 1/406 381/92
8,184,801 B1 * 5/2012 Hamalainen ..... H04M 9/08 379/406.03
(Continued)

FOREIGN PATENT DOCUMENTS

CN 1851806 10/2006
CN 101263734 9/2008
(Continued)

OTHER PUBLICATIONS

Chen et al "A Minimum distortion Noise Reduction Algorithm with Multiple Microphones", IEEE Transactions on Audio, Speech, and Language Processing, vol. 16, No. 3, Mar. 2008, p. 481-493.*
(Continued)

*Primary Examiner* — Leshui Zhang
(74) *Attorney, Agent, or Firm* — Lowenstein Sandler LLP

(57) ABSTRACT

A differential microphone array includes a number (M) of microphone sensors for converting sound to a number of electrical signals, and a processor, operably coupled to the microphone sensors, to specify a target differential order (N) for the differential microphone array, and wherein M>N+1, specify a steering matrix D comprising N+1 steering vectors, calculate a respective one of a plurality of linearly specify a steering matrix D comprising N+1 steering vectors-constrained minimum variance filters based on the steering matrix, apply the respective one of the plurality of linearly-constrained minimum variance filters to a respective one of the electrical signals to calculate a respective frequency response of the electrical signals, wherein the respective frequency response comprises a plurality of components associated with a plurality of subbands, and sum the frequency responses of the electrical signals with respect to
(Continued)

each subband to calculate an estimated frequency spectrum of the sound.

15 Claims, 10 Drawing Sheets

(51) Int. Cl.
*H04R 1/40* (2006.01)
*H04R 1/08* (2006.01)

(52) U.S. Cl.
CPC .... *H04R 2201/403* (2013.01); *H04R 2430/03* (2013.01); *H04R 2430/21* (2013.01)

(58) Field of Classification Search
CPC ..... H04R 2430/25; H04R 2201/403; H04R 3/00; H04R 3/005; H04R 1/406; H04R 1/40; H04R 1/08; H04R 1/32; H04R 1/326; H04R 1/342; H04R 2499/11; H04R 5/027; H04R 2430/00; H04R 2430/03; H04R 2430/20; H04R 2430/21; H04R 2430/23; H04R 2201/40; H04R 2201/401; H04R 27/00; H04R 29/004; H04R 29/006; H04R 17/02; H04R 19/04; H04R 2203/12; H04R 2410/05; H04R 2460/07; H04L 27/01; H04B 7/17; H04B 15/00; H04B 3/20; H04B 3/23; H04M 1/00; G10K 11/16; H03G 5/00; H03G 5/005; H03G 5/16; H03G 5/165; H03G 5/24; H03G 5/28; H03G 9/005; H03G 9/24; H03G 9/025; H03G 2201/702; H03G 7/007
USPC ..... 381/13, 16, 23, 23.1, 26, 56, 57, 61, 66, 381/313, 316, 320, 321, 71.1, 71.3, 71.6, 381/71.11, 71.12, 71.13, 71.14, 73.1, 74, 381/79, 86, 91, 92, 94.1, 94.2, 94.3, 94.5, 381/94.6, 94.9, 95, 97, 98, 99, 100, 101, 381/102, 103, 110, 111, 112, 113, 114, 381/115, 119, 122, 123; 700/94; 379/406.01–406.16; 455/596.2, 570; 704/E19.014, E21.002, E21.007
See application file for complete search history.

(56) References Cited

U.S. PATENT DOCUMENTS

2004/0001598 A1* 1/2004 Balan ..... G06K 9/0057 381/92
2004/0072336 A1* 4/2004 Parra ..... G06K 9/624 435/287.2
2004/0175005 A1* 9/2004 Roeck ..... H04R 25/407 381/74
2007/0127736 A1* 6/2007 Christoph ..... H04R 1/406 381/92
2007/0165879 A1* 7/2007 Deng ..... H04R 3/005 381/92
2008/0152167 A1* 6/2008 Taenzer ..... H04R 3/005 381/94.2
2008/0159559 A1* 7/2008 Akagi ..... G10L 21/0208 381/92
2008/0260175 A1* 10/2008 Elko ..... H04R 3/005 381/73.1
2009/0175466 A1* 7/2009 Elko ..... H04R 3/005 381/94.2
2009/0279715 A1* 11/2009 Jeong ..... H04R 3/005 381/92
2009/0304203 A1* 12/2009 Haykin ..... G10L 21/02 381/94.1
2010/0150375 A1* 6/2010 Buck ..... G10L 25/78 381/94.1
2011/0044462 A1* 2/2011 Yoshioka ..... 381/66
2011/0206212 A1* 8/2011 Derkx ..... H04R 3/005 381/66
2011/0286609 A1* 11/2011 Faller ..... H04R 3/005 381/92

FOREIGN PATENT DOCUMENTS

CN 101976565 2/2011
CN 102506552 6/2012
EP 1370112 12/2003

OTHER PUBLICATIONS

Frost, "An Algorithm for Linearly Constrained Adaptive Array Processing", Proceedings of The IEEE, vol. 60, No. 8, Aug. 1972, p. 926-935.*
Vuppala Performance Analysis of Speech Enhancement Methods in Hands-Free Communication with Emphasis on Wiener Beamformer, Apr. 2012, p. 1-90.*
Cox et al "Robust Adaptive Beamforming", IEEE Transactions on Acoustics, Speech, and Signal Processing, vol. ASSP 35, No. 10, Oct. 1987, p. 1365-1376.*
International Search Report and Written Opinion issued in the corresponding PCT Application No. PCT/CN2012/085830, dated Aug. 15, 2013, 12 pages.
Him, "Adaptive Beamforming—Linearly Constrained Minimum Variance (LCMV) Beamforming", DSP Seminar, May 6, 2008.
Guo, et al., "On WF-LCMV Beamformer Design," Journal of Tianzhong, Oct. 2009, vol. 24, No. 5, pp. 10-12.
Ding, "A Summary About a Speech Enhancement Method Based on Microphone Array," Popular Science and Technology, Mar. 2011, No. 3, pp. 29-30.
Zhang et al., "A Robust Speech Enhancement Method for Difference Noice Field," Journal of Dalian Jiatong University, Aug. 2010, vol. 31, No. 4, pp. 29-32.
Frost, "An Algorithm for Lineary Constrained Adaptive Array Processing," Proceedings of the IEEE, Aug. 1972, vol. 60, No. 8, pp. 926-935.

* cited by examiner

LOW NOISE DIFFERENTIAL MICROPHONE ARRAYS

RELATED APPLICATION

The application is a continuation of U.S. patent application Ser. No. 13/816,430, filed on Feb. 11, 2013, which was the National Stage of International Application PCT/CN2012/085830, filed on Dec. 4, 2012.

FIELD OF THE INVENTION

The present invention is generally directed to differential microphone arrays (DMAs), and, in particular, to DMAs that have low noise amplification.

BACKGROUND

Microphone arrays may include a number of geographically arranged microphone sensors for receiving sound signals (such as speech signals) and converting the sound signals to electrical signals. The electrical signals may be digitized by analog-to-digital converters (ADCs) for converting into digital signals which may be further processed by a processor (such as a digital signal processor). Compared with a single microphone, the sound signals received at microphone arrays may be further processed for noise reduction/speech enhancement, sound source separation, de-reverberation, spatial sound recording, and source localization and tracking. The processed digital signals may be packaged for transmission over communication channels or converted back to analog signals using a digital-to-analog converter (ADC). Microphone arrays have also been configured for beamforming, or directional sound signal reception. The processor may be programmed as if to receive sound signals from a specific sound source.

Additive microphone arrays may achieve signal enhancement and noise suppression based on synchronize-and-add principles. To achieve better noise suppression, additive microphone arrays may include a large inter-sensor distance. For example, the distance between microphone sensors in additive microphone arrays may range from a couple of centimeters to a couple of decimeters. Because of the large inter-sensor spacing, the bulk size of additive microphone arrays may be large. For this reason, additive microphone arrays may not be suitable for many applications. Additionally, additive microphones may suffer the following drawbacks. First, the beam patterns of additive microphone arrays are frequency-dependent and the widths of the formed beams are inversely proportional to the frequency. Therefore, additive microphone arrays are not effective in dealing with low-frequency noise and interference. Second, the noise component from the additive microphone arrays is generally attenuated in a non-uniform manner over the entire spectrum, resulting in undesirable artifacts in the output. Finally, when the incident angle of the target speech source is different from the array's facing direction (a situation which may often occur in practice), the speech signal may be low-pass filtered, resulting in speech distortion.

In contrast, differential microphone arrays (DMAs) allow for small inter-sensor distance, and may be made very compact. DMAs include an array of microphone sensors that are responsive to the spatial derivatives of the acoustic pressure field. For example, the outputs of a number of geographically arranged omni-directional sensors may be combined together to measure the differentials of the acoustic pressure fields among microphone sensors. Thus, different orders of DMAs may be constructed from omni-directional microphone sensors so that the DMAs may have certain directivity. FIG. 1 illustrates a third-order DMAs. As shown in FIG. 1, the first-order signal differentials of the DMAs may be constructed by subtracting two nearby omni-directional microphone sensors' outputs. Second-order differential DMAs may be constructed by subtracting two nearby first-order differential outputs. Similarly, third-order differential DMAs may be constructed by subtracting two nearby second-order differential outputs. Similarly, an Nth order differential DMAs may be constructed from subtracting two differentials of order N−1.

Compared to additive microphone arrays, DMAs have the following advantages. First, DMAs may form frequency-independent beam patterns so that they are effective for processing both high- and low-frequency signals. Second, DMAs have the potential to attain maximum directional gain with a given number of microphones sensors. Third, the gains of DMAs decrease with the distance between the sound source and the arrays, and therefore inherently suppress environmental noise and interference from far-away sources.

An Nth order DMA may be constructed from at least N+1 microphone sensors. As shown in FIG. 1, the DMA may be constructed in the time domain by directly differentiating the output signals of two nearby microphone sensors at the first-order level or their corresponding derivatives at higher order levels. The implementation as shown in FIG. 1 has drawbacks. For example, each level of differential outputs of the DMA requires equalization filters for compensating the array's non-uniform frequency response, particularly for high-order DMAs. Equalization filters have been difficult to design and tune in practice.

Another drawback is that DMAs may amplify sensor noise. Each microphone sensor may include membranes what may vibrate in response to sound waves to convert pressures applied by the sound waves into electrical signals. The generated electrical signals include sensor noise in addition to the measurements of the sound. Unlike environmental noise, the sensor noise is inherent to the microphone sensors and therefore is present even in a soundproof environment such as a sound booth. Typically, microphone array outputs may have 20-30 dB of white noise due to the sensors depending on the quality of microphone sensors. DMAs are known for amplification of sensor noise; and, the higher order DMAs, the larger the amplification. For example, a third-order DMA of current art may amplify the sensor noise to about 80 dB, rendering the DMA useless for practical purposes.

One way to reduce the sensor noise is to use larger membranes in the microphone sensors. However, both larger membranes and larger microphone sensors increase the bulk size of DMAs. Another way to reduce the sensor noise is to use materials that generate less noise. However, the lower the generated sensor noise, the more expensive the microphone sensors. For example, a 20 dB microphone sensor can be much more expensive than a 30 dB microphone sensor. Finally, no matter how microphone sensors are fabricated, the sensor noise inherently exists and is subject to amplification by DMAs. Thus, the presently available and/or known DMAs are limited to one or two orders of differentials. Accordingly, a need exists to improve over the present DMAs and provide an improved low noise differential microphone array.

DETAILED DESCRIPTION

Figure 1:
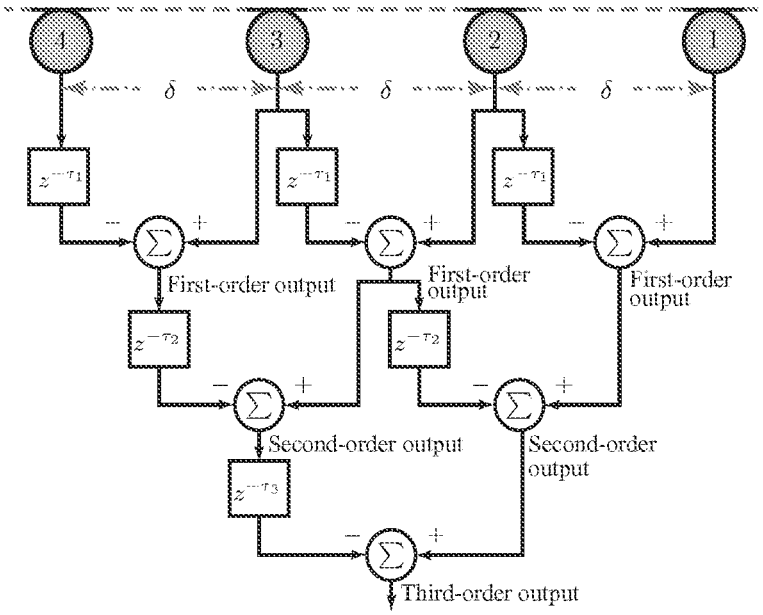
FIG. 1 (Prior Art)
FIG. 1 shows a three-level differential microphone array.

There exists a need for differential microphone arrays that are easy to design and can reduce and/or eliminate amplification of sensor noise.

Embodiments of the present invention include a differential microphone array (DMA) that include a number (M) of microphone sensors for converting a sound to a number of electrical signals and a processor that is configured to apply linearly-constrained minimum variance filters on the electrical signals over a time window to calculate frequency responses of the electrical signals over a plurality of subbands and sum the frequency responses of the electrical signals for each subband to calculate an estimated frequency spectrum of the sound.

In embodiments of the present invention, the number of microphone sensors is larger than the order of the DMA plus one, and the linearly-constrained minimum variance filters are minimum-norm filters. In other embodiments of the present invention, the number of microphone sensors is equal to the order of the DMA plus one.

Embodiments of the present invention include a method for operating a differential microphone array that includes a number (M) of microphone sensors for converting sound to electrical signals. The method includes applying linearly-constrained minimum variance filters on the electrical signals over a time window to calculate frequency responses of the electrical signals over a plurality of subbands and summing the frequency responses of the electrical signals for each subband to calculate an estimated frequency spectrum of the sound.

Embodiments of the present invention include a method for designing reconstruction filters for a differential microphone array including a number (M) of microphone sensors. The method includes specifying a target differential order (N) for the differential microphone array, specifying N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]^T$, where n=1, 2, . . . , N, $j=\sqrt{-1}$, ω is the angular frequency, $\tau_0=\delta/c$, where δ is inter-sensor distance, and c is the sound speed, specifying a steering matrix $D=[d^H(\omega,1), d^H(\omega, \alpha_{N,1}), \ldots, d^H(\omega, \alpha_{N,N})]^T$, and calculating the reconstruction filters as a function of D and target beam patterns.

Embodiments of the present invention include a differential microphone array including a plurality of microphone sensors for receiving a speech signal and whose outputs are divided into frames. In an embodiment, the frames of the outputs are transformed into a frequency response by a frequency transform. In an embodiment, the frames are transformed using short-time Fourier transform (STFT). Other types of frequency transform that may be used to generate a frequency response include discrete cosine transform (DCT) and wavelet based transforms. The frequency responses can be divided into a plurality of subbands. In each subband, a differential beamformer is designed and applied to the frequency response coefficients to produce an estimate of clean signal in the subband. Finally, the clean speech signal is reconstructed by summing the inverse frequency transform of the frequency responses.

Figure 2A:
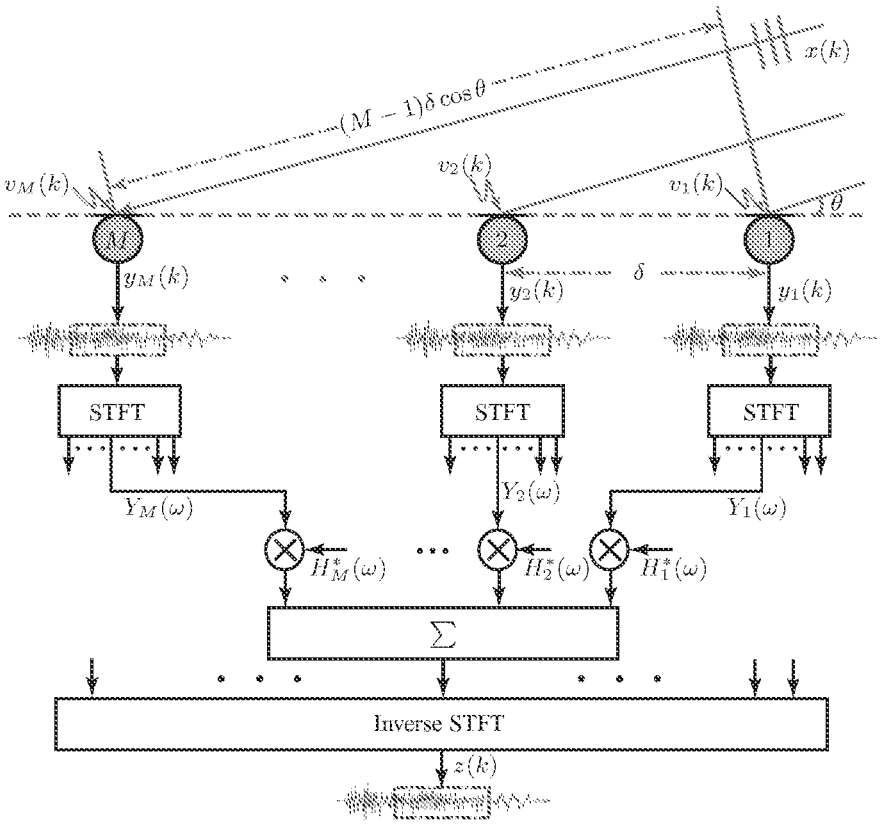
FIG. 2A shows a differential microphone array according to an embodiment of the present invention.

FIG. 2A shows a DMA that is designed in subbands using beamformers according to an embodiment of the present invention. The DMA can include a number of microphone sensors 1, 2, . . . , M, each of which may receive a sound signal x(k). Because of the distance between microphone sensors, each microphone sensor may receive the sound signal at different times or with different amounts of time delays. Additionally, each microphone sensor may receive environmental noise. As shown in FIG. 2A, the respective environmental noise component can be denoted by $v_1(k)$, $v_2(k)$, . . . , $v_M(k)$. Thus, the output signals $y_1(k)$, $y_2(k)$, . . . , $y_M(k)$ of microphone sensors may include a delayed version of the sound signal and an environmental noise, as well as sensor noise component. Since the sensor noise component is additive to the environmental noise component, $v_1(k)$, $v_2(k)$, . . . , $v_M(k)$ are deemed to include sensor noise as well for convenience. For example, a time window can be applied to each of the output signals from microphone sensors to capture a frame of the output signals. For example, the time window is a rectangular window, a Hamming window, and/or a window suitable to capture a frame of output signals. In an embodiment, a frequency transform (such as Fourier transform) is applied to the frame of output signals $y_1(k)$, $y_2(k)$, . . . , $y_M(k)$ to produce the frequency response $y(\omega)=[Y_1(\omega), Y_2(\omega), \ldots, Y_M(\omega)]$, where ω=0, 1, 2, . . . , K, indicating K+1 subbands. In an embodiment, there may be 128 subbands. Here, the window index is omitted for clarity. In an embodiment, the frequency transform is a short-time Fourier transform. Alternatively, the frequency transform is a suitable type of transform such as DCT or wavelet based transform. For clarity and convenience, the following is discussed in terms of short-time Fourier transform. However, it is understood that the same principles may be applied to other types of frequency transforms. For a uniform linear array where the microphone sensors are arranged along a line and has equal inter-sensor distance δ when the sound signal has an incident angle θ and if the position of the first microphone is chosen as the reference microphone, the STFT of the $m^{th}$ microphone is given by $$Y_m(\omega)=e^{-j(m-1)\omega\tau_0\alpha}X(\omega)+V_m(\omega) \quad (1)$$

where $X(\omega)$ and $V_m(\omega)$ are, respectively, the STFT of the source signal x(k) and the noise component $v_m(k)$, $j=\sqrt{-1}$ (or the imaginary unit), $\omega=2\pi f$ is the angular frequency, $\tau_0=\delta/c$ (c is the sound speed) is the delay between two successive microphone sensors at angle $\theta=0°$, and $\alpha=\cos(\theta)$. Embodiments of the present invention may be similarly applicable to non-uniform array. For a non-uniform array of microphone sensors, for example, Equation (1) can be written as $Y(\omega)=e^{-j\omega\tau_m\alpha}X(\omega)+V_m(\omega)$, where $\tau_m$, m=1, 2, . . . , M, represent the inter-sensor distances. For clarity and convenience, the following is discussed in terms of uniform linear array. However, it is understood that the same principles may be applied to non-uniform linear array. In a vector form, $$y(\omega)=d(\omega,\alpha)X(\omega)+v(\omega) \tag{2}$$

where $v(\omega)=[V_1(\omega), V_2(\omega), \ldots, V_M(\omega)]^T$, and $d(\omega, \alpha)=[1, e^{-j\omega\tau 0\alpha}, \ldots, e^{-j(M-1)\omega\tau 0\alpha}]^T$ is the steering vector (of length M) at the frequency $\omega$, and the superscript T denotes a transpose operator.

Figure 2B:
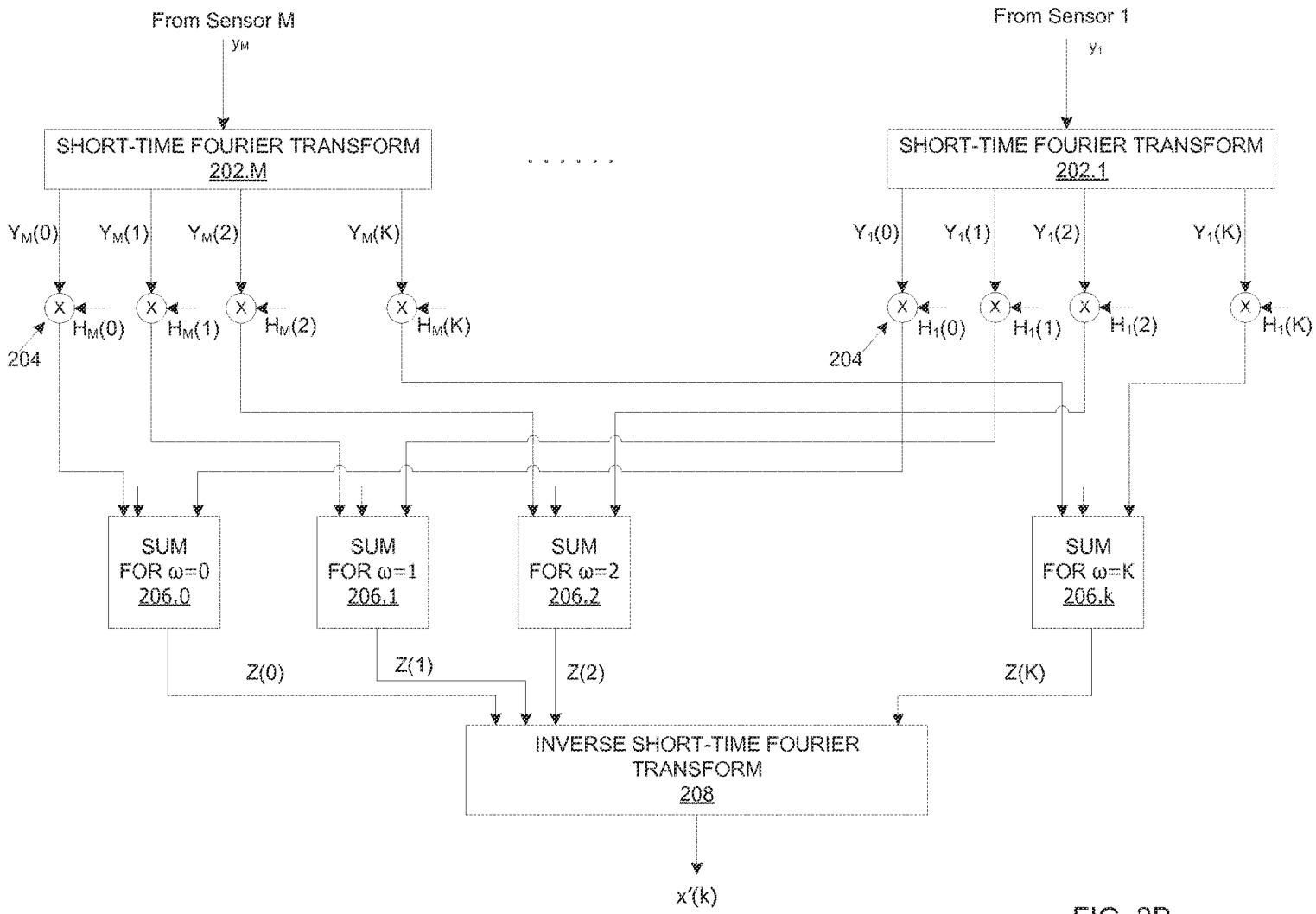
FIG. 2B shows a detailed illustration of a differential microphone array according to an embodiment of the present invention.

Embodiments of the present invention include the design of DMAs as beamformers that recover the spectrum of the desired signal $X(\omega)$ based on the observed $y(\omega)$. As shown in FIG. 2A, this recovery can be achieved, for example, by applying complex weights $H^*_m(\omega)$. m=1, 2, . . . , M to the output of each microphone sensor, where * denotes complex conjugation. FIG. 2B illustrates, in detail, the filtering in subbands according to an embodiment of the present invention. As shown in FIG. 2B, after short-time Fourier transform 202.1, . . . , 202.M, the electrical signals may be decomposed into subbands $\omega$=0, 1, 2, . . . , K. For example, y1 may be decomposed into $Y_1(0), Y_1(1), \ldots, Y_1(K)$, and $y_M$ may be decomposed into $Y_M(0), Y_M(1), \ldots, Y_M(K)$. A set of filters $H_i(\omega)$, i=1, . . . , M, may be applied to each $Y_i(\omega)$, i=1, . . . , M.

Referring to FIG. 2A, the weighted output $y(\omega)$ may be summed together to calculate the estimated spectrum of the sound signal:

$$Z(\omega)=\sum_{m=1}^{M} H_m^*(\omega)Y_m(\omega)=h^H(\omega)y(\omega). \tag{3}$$

where $h(\omega)=[H_1(\omega), H_2(\omega), \ldots, H_M(\omega)]^T$. As shown in FIG. 2B in detail, the production of $H^*_m(\omega)Y_m(\omega)$ can be accomplished in subbands $\omega$=0, 1, 2, . . . , K, through a plurality of multiplication operator 204. Also, the sum is also accomplished in the subbands through sum operators 204.0, 204.1, . . . , 204.K respectively for subbands $\omega$=0, 1, 2, . . . , K. As shown in FIG. 2B, the estimate for subband $\omega$=i is Z(i).

The design of the DMA is then to determine the weight vector $h(\omega)$ so that $Z(\omega)$ is an optimal estimate of $X(\omega)$. As indicated by Equation (2), $y(\omega)$ includes noise component $v(\omega)$ which may include both environmental noise and sensor noise. The weight vector $h(\omega)$ may be determined by adaptive beamforming to minimize the noise component. In adaptive beamforming, the noise component may be minimized for certain beam patterns, or $$\min_{h(\omega)} h^H(\omega)\Phi_v(\omega)h(\omega) \text{ subject to: } D(\omega, \alpha)h(\omega)=\beta \tag{4}$$

where the superscript H denotes a transpose complex conjugation. A linearly constrained minimum variance (LCMV) filter solution for Equation (4) is:

$$h_{LCMV}(\omega)=\Phi_V^{-1}(\omega)D^H(\omega,\alpha)[D(\omega,\alpha)\Phi_V^{-1}(\omega)D^H(\omega,\alpha)]^{-1}\beta, \tag{5}$$

in which $\alpha$ and $\beta$ include vectors through which the certain beam patterns may be defined, and $\Phi(\overline{\omega})=E[v(\omega)v^H(\omega)]$ is the correlation matrix of the noise vector. In an embodiment, the $\alpha=[1, \alpha_{N,1}, \ldots, \alpha_{N,N}]^T$ vector specifies the angular locations of nulls, and $\beta=[1, \beta_{N,1}, \ldots, \beta_{N,N}]^T$ vector specifies the gains of each corresponding null. The gain is a value within a range [0, 1], where a zero gain may mean no sound passing through in that direction and a unit gain may mean a total passing through with no loss. Together, vectors $\alpha$ and $\beta$ specify the target beam patterns.

In an embodiment, M=N+1. Thus, D is a fully ranked square matrix, and $$h_{LCMV}(\omega)=D^{-1}(\omega,\alpha)\beta, \tag{6}$$

which corresponds exactly to the filter of an Nth-order DMA. However, because of $h_{LCMV}(\omega)$ is designed in the frequency domain and is derived directly from the steering vectors d and the beam pattern $\beta$, $h_{LCMV}(\omega)$ is designed in the frequency domain. In this way, embodiments of the present invention do not need to calculate the equalization filters which are hard to design, and therefore, embodiments of the present invention have the advantage of easier calculation.

Current art requires that M=N+1 so that steering matrix D is always a square matrix that can be inversed. If M>N+1, the steering matrix D is not a square matrix. In an embodiment of the present invention, when M>N+1, the filter is designed to be a minimum-norm filter, or $$h(\omega,\alpha,\beta)=D^H(\omega,\alpha)[D(\omega,\alpha)D^H(\omega,\alpha)]^{-1}\beta, \tag{7}$$

where the selection of vectors $\alpha$ and $\beta$ of length N+1 may determine the response and the order of the DMA. Since M may be much larger than N+1, the DMA designed according to the minimum-norm filter $h(\omega,\alpha,\beta)$ is much more robust against the noise, especially against the sensor noise. This is because, for example, the minimum-norm filter $h(\omega,\alpha,\beta)$ is also be derived from maximizing the white noise gain subject to the Nth order DMA fundamental constraints. Therefore, for a large number of microphone sensors, the white noise gain may approach M. If the value of M is much larger than N+1, the order of the DMA may not be equal to N anymore. However, since the Nth order DMA fundamental constraints is fulfilled, the resulting shape of the directional pattern may be slightly different than the one obtain when M=N+1. In this way, the DMA designed according to the minimum-norm filter $h(\omega,\alpha,\beta)$ may effectively achieve an effective trade-off between good noise suppression and beam forming.

The beam pattern derived using the minimum-norm filter is $$B[h(\omega,\alpha,\beta),\theta]=d^H(\omega, \cos\theta)D^H(\omega,\alpha)[D^H(\omega,\alpha)D^H(\omega,\alpha)]^{-1}\beta. \tag{8}$$

The white noise gain, directivity factor, and the gain for a point noise source for the minimum-norm filters are, respectively, $$G_{Wn}[h(\omega, \alpha, \beta)]=\frac{1}{\beta^T[D(\omega, \alpha)D^H(\omega, \alpha)]^{-1}\beta}, \tag{9}$$

$$G_{dn}[h(\omega, \alpha, \beta)]=\frac{1}{h^H(\omega, \alpha, \beta)\Gamma_{dn}(\omega)h(\omega, \alpha, \beta)}, \tag{10}$$

$$G_{ns}[h(\omega, \alpha, \beta)]=\frac{1}{|B[h(\omega, \alpha, \beta), \theta_n]|^2}, \tag{11}$$

where $\theta_n$ is the incident angle for a point noise source.

As discussed above, the trade-off is between $G_{dn}[h(\omega,\alpha,\beta)]=G_N$ and $G_{Wn}[h(\omega,\alpha,\beta)]\geq 1$, where $G_N$ is the directivity factor of the frequency-independent N-th order DMA.

Thus, embodiments of the present invention include a process for calculating a set of filters that can be used to reconstruct the sound signals. For example, the reconstruction filters specify coefficients at a number of subbands.

Figure 3B:
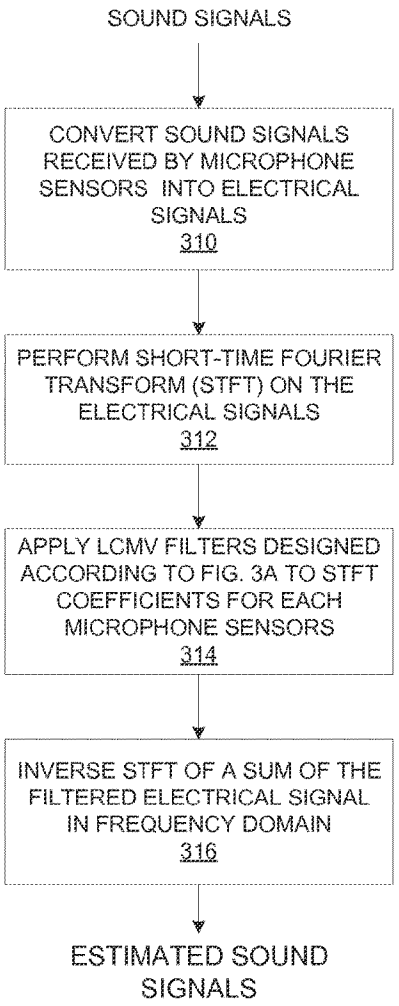
FIG. 3B shows a process for operating DMAs according to an embodiment of the present disclosure.
Figure 3A:
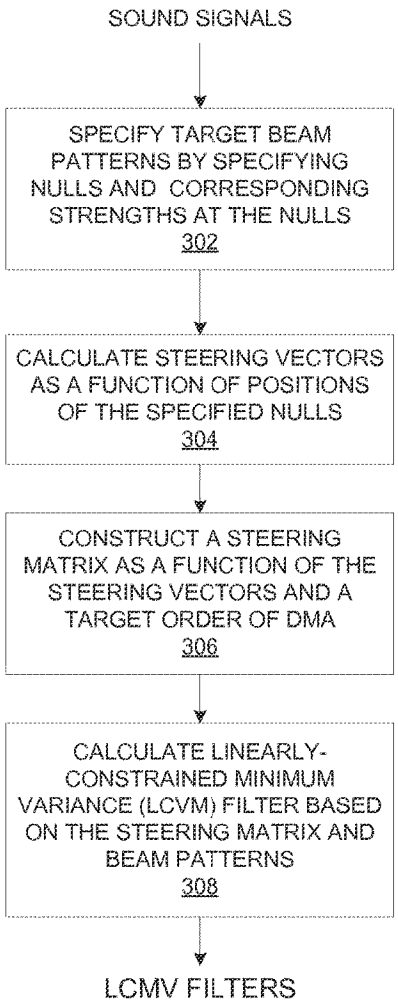
FIG. 3A shows a process for constructing DMA filters according to an embodiment of the present disclosure.

FIG. 3A shows a process for calculating a set of linearly-constrained minimum variance filters for a differential microphone array (DMA) according to an embodiment of the present invention. For example, the DMA includes a plurality of microphone sensors, each of which may receive sound from a sound source and convert the sound into electrical signals, and a processor that may be configured to filter the electrical signals. As shown in FIG. 3A, at 302, target beam patterns can be specified by assigning locations of nulls and weights at these nulls. In an embodiment, a first vector $\alpha=[1, \alpha_{N,1}, \ldots, \alpha_{N,N}]^T$ specifies angular locations of the nulls, and a second vector $\beta=[1, \beta_{N,1}, \ldots, \beta_{N,N}]^T$ specifies the gains for these nulls. The number of nulls is related to the order of the DMA. In an embodiment, the number of nulls (L) equals to the order (N) plus one, i.e., L=N+1. At 304, steering vectors may be calculated as $$d(\omega,\alpha_{N,n})=[1,e^{-j\omega\tau(0)\alpha_{N,n}}, \ldots, e^{-j(M-1)\omega\tau(0)\alpha_{N,n}}] \tag{12}$$

where n=1, 2, . . . , N. At 306, the steering matrix D may be constructed from the steering vectors $$D(\omega, \alpha) = \begin{bmatrix} d^H(\omega, 1) \\ d^H(\omega, \alpha_{N,1}) \\ \vdots \\ d^H(\omega, \alpha_{N,N}) \end{bmatrix}, \tag{13}$$

which is a M×(N+1) matrix. Thus, if M=N+1, D is a square matrix. However, if M>N+1, D is a rectangular matrix. At 308, a set of linearly-constrained minimum variance filters may be calculated. If the number of microphone sensors M=N+1 (N is the order of the DMA), D is a square matrix and $$h_{LCMV}(\omega)=D^{-1}(\omega,\alpha)\beta.$$

However, if M>N+1, $h(\omega, \alpha, \beta)=D^H(\omega, \alpha)[D(\omega, \alpha)D^H(\omega, \alpha)]^{-1}\beta$, which is a minimum-norm filter which suppresses noise amplification.

For example, the calculated linear-constrained minimum variance filters or the minimum-norm filter is used to reconstruct the sound source. FIG. 3B shows a process for calculating an estimate of the sound source. At 310, the sound signals can be converted into electrical signals by the microphone sensors in the DMA. For example, the electrical signals can include different amounts of delay because of the inter-sensor distance. At 312, a processor can be configured to perform a frequency transform such as a short-time Fourier transform on the electrical signals received from the microphone sensors to generate a frequency response of the electrical signals. At 314, the set of linearly-constrained minimum variance filters $h_{LCMV}$ (or the minimum-norm filters for M>N+1) can be applied to the frequency responses of electrical signals of microphone sensors to generate filtered frequency responses. At 316, the filtered frequency responses are summed together at each subband to produce an estimated spectrum of the sound, and an inverse short-time Fourier transform can be applied to the estimated spectrum. The result of the inverse STFT is an estimate of the sound source.

Embodiments of the present invention can be used to construct DMAs of different orders, including first-order cardioid (in which $\alpha=[1, -1]^T$, $\beta=[1, 0]^T$), second-order cardioid ($\alpha=[1, -1, 0]^T$, $\beta=[1, 0, 0]^T$), and third-order cardioid ($\alpha=[1, -1, 0, \sqrt{2}/2]^T$, $\beta=[1, 0, 0, -\sqrt{2}/8+1/4]^T$). The number of microphone sensors used for the construction can equal to the order plus one or be larger than the order plus one. Experimental results have demonstrated that DMAs designed using the minimum-norm filters exhibit superior robustness against noise.

Figure 4A:
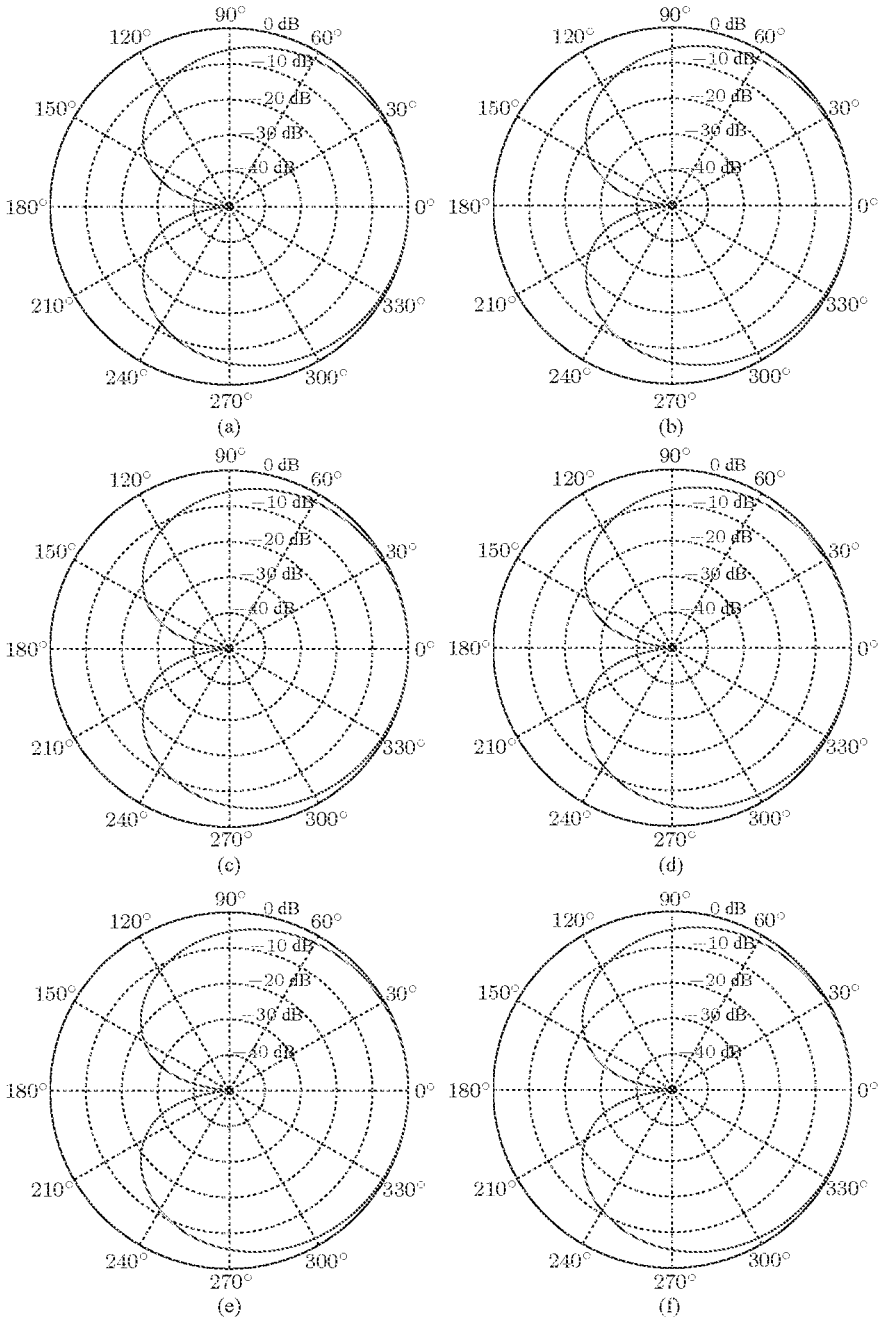
FIG. 4A shows beam patterns of a first-order cardioid DMA designed using two microphone sensors according to an embodiment of the present disclosure.
Figure 4B:
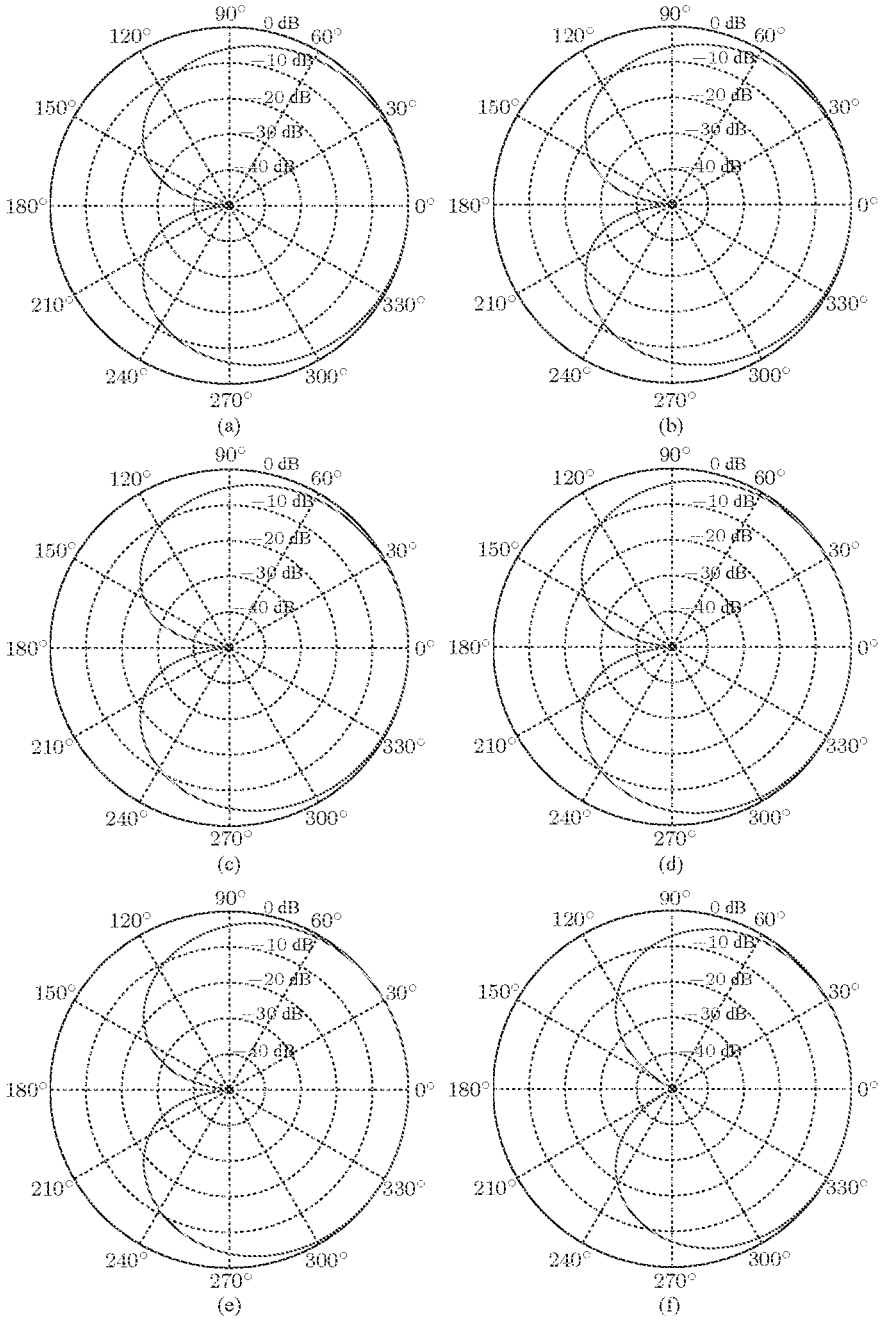
FIG. 4B shows beam patterns of a first-order cardioid DMA designed using five microphone sensors according to an embodiment of the present disclosure.
Figure 4C:
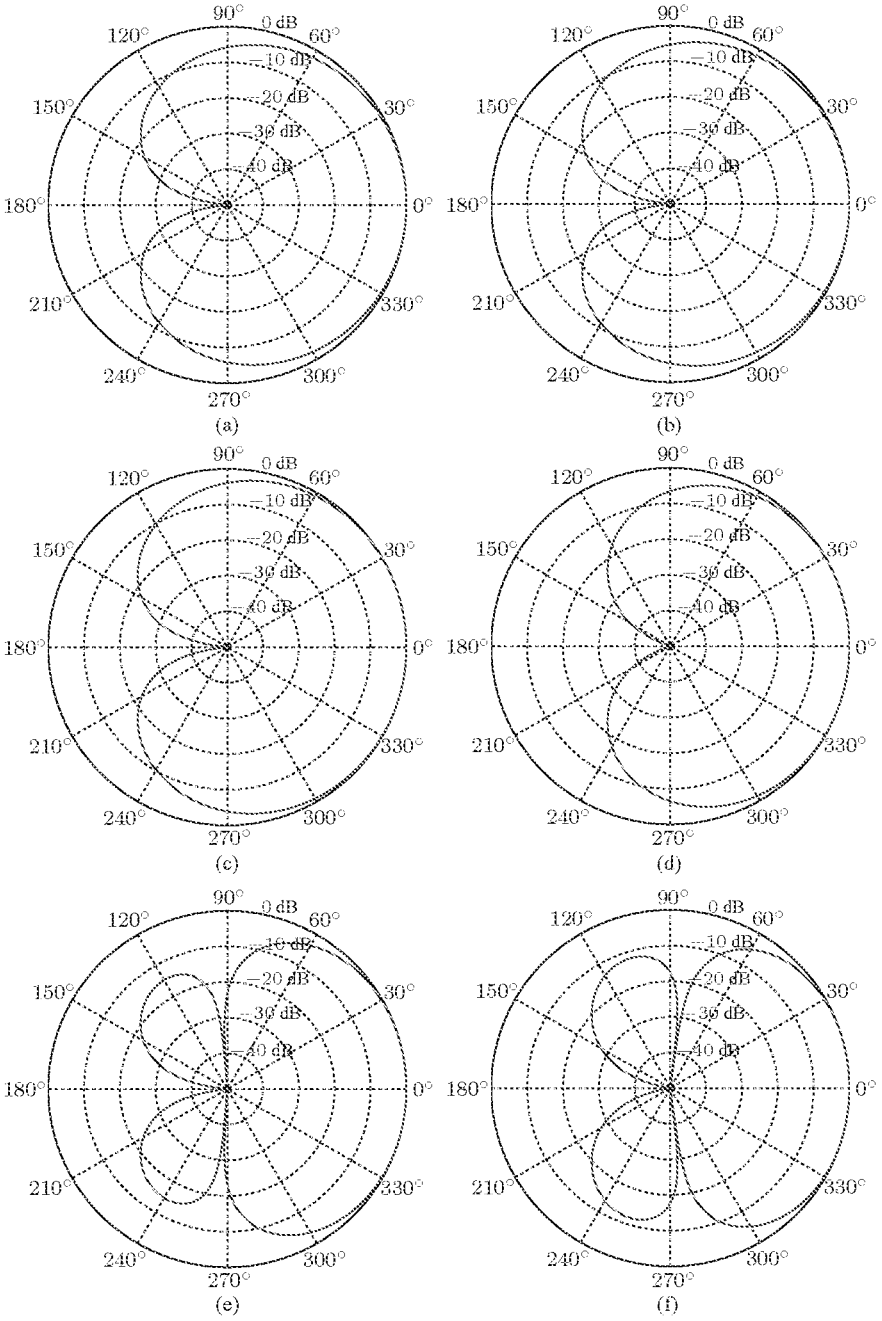
FIG. 4C shows beam patterns of first-order cardioid DMA designed using eight microphone sensors according to an embodiment of the present disclosure.

Embodiments of the present invention can use different numbers of microphone sensors to construct a first-order cardioid DMA, in which $\alpha=[1, -1]^T$ (namely, the two nulls are placed at 0° and 180°), and $\beta=[1, 0]^T$ (the strength at 0° and 180° are set 1 and 0, respectively). FIGS. 4A, 4B and 4C show the beam patterns of the first-order cardioid DMA designed using two, five, and eight microphone sensors, respectively, according to embodiments of the present invention. The beam patterns for the two and five microphone sensors are similar except for at around 5 kHz. As to the first-order cardioid DMA designed using eight microphone sensors, the beam patterns at 4 and 5 kHz exhibit characteristics of a second-order cardioid DMA. Thus, the DMA designed using eight microphone sensors may exhibit the characteristics of a first-order cardioid at low frequencies and characteristics of a second-order cardioid at high frequency. This hybrid characteristic may be desirable because it can achieve low noise in the low frequency range and high directivity in the high frequency range.

Figure 4D:
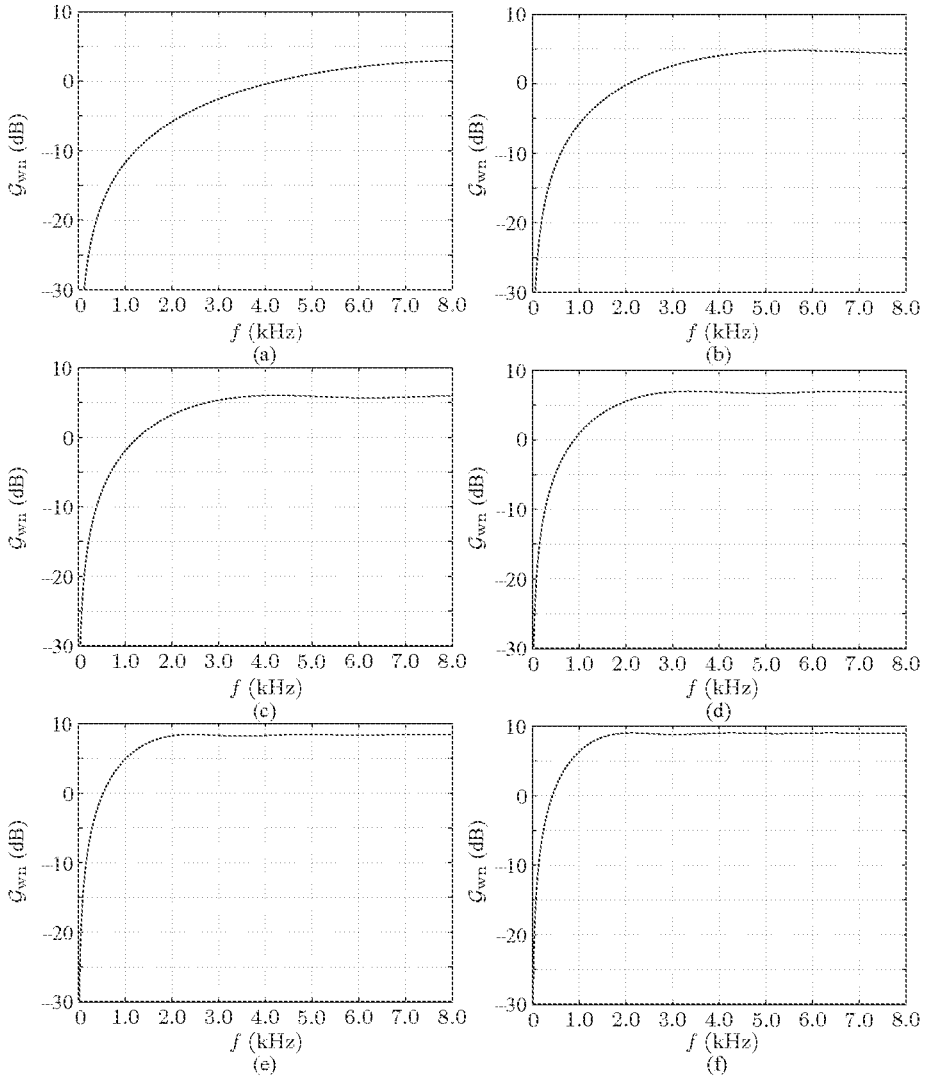
FIG. 4D shows white noise gains of first-order cardioid DMAs according to an embodiment of the present disclosure.

FIG. 4D shows plots of the white noise gains $G_{Wn}$ as a function of frequency for first-order cardioid DMAs designed using 2 to 6, 7, and 8 microphone sensors according to embodiments of the present invention. When the number of microphone sensors M is greater than two, the solutions are minimum-norm solutions. As shown in FIG. 4D, the maximum white noise gains can be reached at 2 kHz or above for seven and eight microphone sensors. Compared DMAs with two and five microphone sensors, at 1 kHz, the white noise gain is at 0 dB for five microphone sensors, and −11 dB for two microphone sensors. Thus, a gain of 11 dB can be achieved using five microphone sensors compared to using two microphone sensors.

Figure 5:
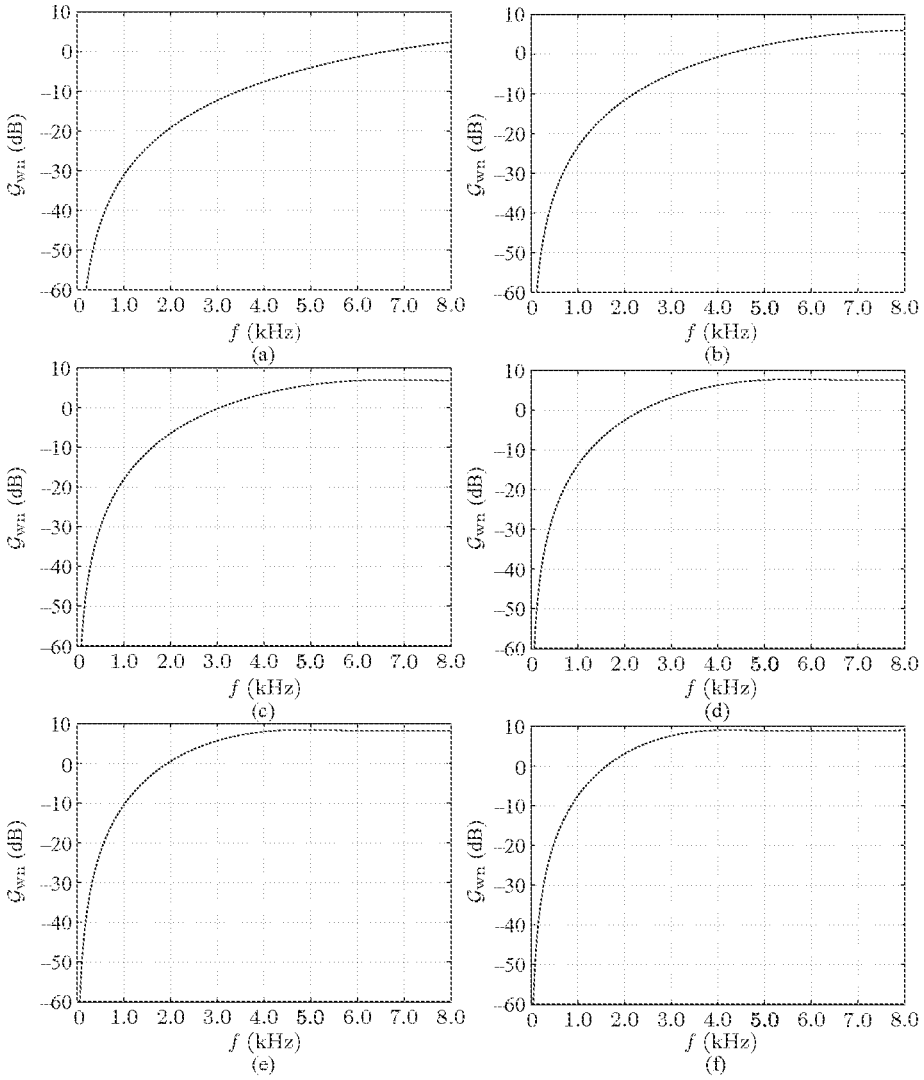
FIG. 5 shows white noise gains of second-order cardioid DMAs according to an embodiment of the present disclosure.

Embodiments of the present invention can use different numbers of microphone sensors to construct second-order cardioid DMAs, in which $\alpha=[1, -1, 0]^T$, $\beta=[1, 0, 0]^T$. FIG. 5 shows plots of the white noise gains $G_{Wn}$ for the second-order DMAs designed using 3 to 8 microphone sensors as a function of frequency according to embodiments of the present invention. When the number of microphone sensors M is greater than three, the solutions are minimum-norm solutions. As shown in FIG. 5, the white noise gain increases as the number (M) of microphone sensors increases. For example, at 1 kHz, the minimum-norm DMA of five microphone sensors may achieve a white noise gain of −19 dB, while three microphone sensors may achieve −30 dB gain. Thus, for example, DMA designed using five microphone sensors here can improve 11 dB over three microphone sensors. The maximum white noise gain may be achieved when M>7 at high frequencies.

Figure 6:
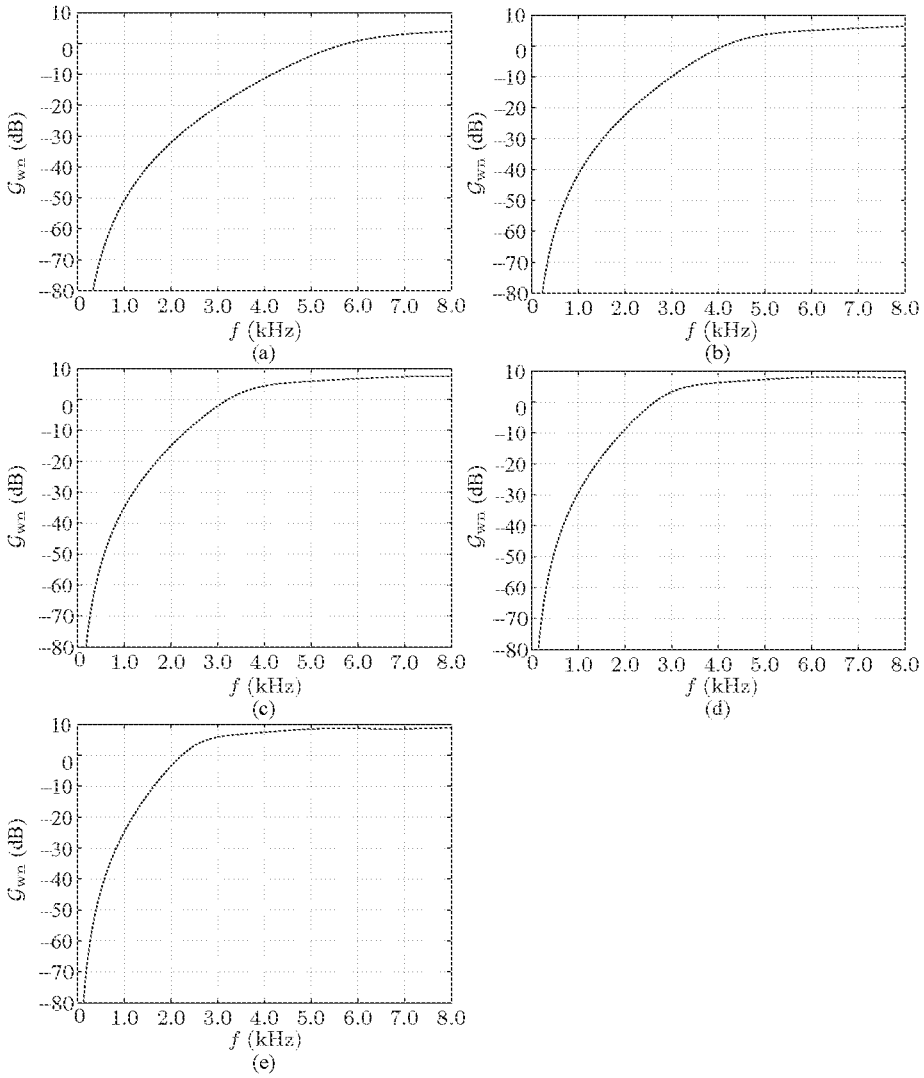
FIG. 6 shows white noise gains of third-order cardioid DMAs according to an embodiment of the present disclosure.

Embodiments of the present invention use different numbers of microphone sensors to construct a third-order cardioid, in which $\alpha=[1, -1, 0, -\sqrt{2}/2]^T$, $\beta=[1, 0, 0, -\sqrt{2}/8+1/4]^T$. FIG. 6 shows plots of the white noise gains $G_{Wn}$ for third-order cardioids designed using 4 to 8 microphone sensors as a function of frequency according to embodiments of the present invention. When the number of microphone sensors M is greater than four, the solutions are minimum-norm solutions. As shown in FIG. 6, the white noise gain improves as the number of microphone sensors increase. For example, at 1 kHz, the white noise gain for the third-order cardioid designed using eight microphone sensors is −24 dB, while the third-order cardioid designed using four microphone sensors is −50 dB. Thus, for example, the minimum-norm DMAs designed here using eight microphone sensors can achieve a 26 dB improvement over the DMAs using four microphone sensors.

Embodiments of the present invention provide a low noise differential microphone array that is an improvement above known DMAs. Embodiments of the present invention provide a differential microphone array, including a number (M) of microphone sensors for converting a sound to a number of electrical signals; and a processor which is configured to: apply linearly-constrained minimum variance filters on the electrical signals over a time window to calculate frequency responses of the electrical signals over a plurality of subbands; and sum the frequency responses of the electrical signals for each subband to calculate an estimated frequency spectrum of the sound. In embodiments, the processor is configured to, prior to applying the linearly-constrained minimum variance filters, calculate a short-time Fourier transform of the electrical signals; and calculate an inverse short-time Fourier transform of the estimated frequency spectrum of the electrical signals. In embodiments, the differential microphone array is one of a uniform linear microphone array and a non-uniform linear microphone array. In embodiments, a differential order of the differential microphone array is N, and the linearly-constrained minimum variance filters are determined by a beam pattern of the differential microphone array. In embodiments, the linearly-constrained minimum variance filter is calculated as a function of a steering matrix D, and the steering matrix D includes N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]^T$, where n=1, 2, . . . , N, $j=\sqrt{-1}$, ω is the angular frequency, $\tau_0=\delta/c$, where δ is inter-sensor distance, and c is the sound speed. In embodiments, M=N+1 and D is a square matrix, and the linearly-constrained minimum variance filters $h_{LCMV}(\omega, \alpha)=D^{-1}(\omega, \alpha)\beta$, where β is a vector specifying the beam pattern. In embodiments, M>N+1 and D is a rectangular matrix, and the linearly-constrained minimum variance filters are minimum-norm filters $h(\omega, \alpha)=D^H(\omega, \alpha)[D(\omega, \alpha)D^H(\omega, \alpha)]^{-1}\beta$.

Embodiments of the present invention provide a method and system for operating a differential microphone array that includes a number (M) of microphone sensors for converting sound to electrical signals, including: applying, by a processor, linearly-constrained minimum variance filters on the electrical signals over a time window to calculate frequency responses of the electrical signals over a plurality of subbands; and summing, by the processor, the frequency responses of the electrical signals for each subband to calculate an estimated frequency spectrum of the sound. In embodiments, prior to applying the linearly-constrained minimum variance filters, calculating a short-time Fourier transform of the electrical signals; and calculating an inverse short-time Fourier transform of the estimated frequency spectrum of the electrical signals. In embodiments of the system and method, the differential microphone array is one of a uniform linear microphone array and a non-uniform linear array. In embodiments of the system and method, a differential order of the differential microphone array is N, and the linearly-constrained minimum variance filters are determined by a beam pattern of the differential microphone array. In embodiments of the system and method, the linearly-constrained minimum variance filter is calculated as a function of a steering matrix D, and the steering matrix includes N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]^T$, where n=1, 2, . . . , N, $j=\sqrt{-1}$, ω is the angular frequency, τ0=δ/c, where δ is inter-sensor distance, and c is the sound speed. In embodiments of the system and method, M=N+1 and D is a square matrix, and the linearly-constrained minimum variance filters $h_{LCMV}(\omega, \alpha)=D^{-1}(\omega, \alpha)\beta$, where β is a vector specifying the beam pattern. In embodiments of the system and method, M>N+1 and D is a rectangular matrix, and the linearly-constrained minimum variance filters are minimum-norm filters $h(\omega, \alpha)=D^H(\omega, \alpha)[D(\omega, \alpha)D^H(\omega, \alpha)]^{-1}\beta$.

Embodiments of the present invention provide a method and system for designing reconstruction filters for a differential microphone array including a number (M) of microphone sensors, including: specifying, by a processor, a target differential order (N) for the differential microphone array; specifying, by the processor, N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]^T$, where n=1, 2, . . . , N, $j=\sqrt{-1}$, ω is the angular frequency, $\tau_0=\delta/c$, where δ is inter-sensor distance, and c is the sound speed; specifying, by the processor, a steering matrix $D=[d^H(\omega,1), d^H(\omega\alpha_{N,1}), \ldots, d^H(\omega, \alpha_{N,N})]^T$; and calculating the reconstruction filters as a function of D and target beam patterns. In embodiments of the method and system, the differential microphone array is one of a uniform linear microphone array and a non-uniform linear microphone array. In embodiments of the method and system, M=N+1 and D is a square matrix, and the reconstruction filters $h(\omega, \alpha)=D^{-1}(\omega, \alpha)\beta$, where β is a vector specifying the beam pattern. In embodiments of the method and system, M>N+1 and D is a rectangular matrix, and the reconstruction filters are minimum-norm filters $h(\omega, \alpha)=D^H(\omega, \alpha)[D(\omega, \alpha)D^H(\omega, \alpha)]^{-1}\beta$.

It will be appreciated that the disclosed methods, systems, and procedures described herein can be implemented using one or more processors executing instructions from one or more computer programs or components. These components may be provided as a series of computer instructions on a computer-readable medium, including, for example, RAM, ROM, flash memory, magnetic, and/or optical disks, optical memory, and/or other storage media. The instructions may be configured to be executed by one or more processors which, when executing the series of computer instructions, performs or facilitates the performance of all or part of the disclosed methods, and procedures.

Although the present disclosure has been described with reference to particular examples and embodiments, it is understood that the present disclosure is not limited to those examples and embodiments. Further, those embodiments may be used in various combinations with and without each other. The present disclosure as claimed therefore includes variations from the specific examples and embodiments described herein, as will be apparent to one of skill in the art.

What is claimed is:

1. A differential microphone array, comprising:

a number (M) of microphone sensors to receive sound signals originated from a sound source and convert the sound signals to a number of electrical signals; and a processor, operably coupled to the microphone sensors, to:

specify a target differential order (N) for the differential microphone array, wherein M>N+1;

construct a steering matrix D comprising N+1 steering vectors;

calculate a respective one of a plurality of linearly-constrained minimum variance filters based on the steering matrix;

apply the respective one of the plurality of linearly-constrained minimum variance filters to a respective one of the electrical signals to calculate a respective frequency response of the electrical signals, wherein the respective frequency response comprises a plurality of components associated with a plurality of subbands;

calculate an estimated frequency spectrum of the sound source by summing the frequency responses of the electrical signals with respect to each one of the plurality of subbands; and reproduce, based on the estimated frequency spectrum, the sound source, wherein the reproduced sound source is an enhanced version of the sound source.

2. The differential microphone array of claim 1, wherein the processor is further to:

prior to applying the respective one of the plurality of linearly-constrained minimum variance filters, calculate a short-time Fourier transform of the respective one of the electrical signals; and calculate an inverse short-time Fourier transform of the estimated frequency spectrum of the sound to generate an estimate of a source of the sound.

3. The differential microphone array of claim 1, wherein the differential microphone array is one of a uniform linear microphone array or a non-uniform linear microphone array.

4. The differential microphone array of claim 1, wherein the steering matrix D is a rectangular matrix, and wherein the steering matrix $D=[d^H(\omega, 1), d^H(\omega, \alpha_{N,}1), \ldots, d^H(\omega, \alpha_{N,N})]^T$, wherein N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]$, wherein $\alpha_{N,n}$ specifies angular locations of nulls, n=1, 2, . . . , N, $j=\sqrt{-1}$, ω represents angular frequency, $\tau_0=\delta/c$, wherein δ represents an inter-sensor distance, and c represents sound speed.

5. The differential microphone array of claim 4, wherein the plurality of linearly-constrained minimum variance filters are minimum-norm filters represented by $h(\omega,\alpha)=D^H(\omega, \alpha)[D(\omega, \alpha)D^H(\omega, \alpha)]^{-1}\beta$, wherein β is a vector specifying a target beam pattern.

6. A method for operating a differential microphone array that comprises a number (M) of microphone sensors to convert sound signals, originated from a sound source and received by the number (M) of microphones, to a number of electrical signals, the method comprising:

specifying a target differential order (N) for the differential microphone array, wherein M>N+1;

constructing, by a processor, a steering matrix D comprising N+1 steering vectors;

calculating a respective one of a plurality of linearly-constrained minimum variance filters based on the steering matrix;

applying the respective one of the plurality of linearly-constrained minimum variance filters to a respective one of the electrical signals to calculate a respective frequency response of the electrical signals, wherein the respective frequency response comprises a plurality of components associated with a plurality of subbands;

calculating an estimated frequency spectrum of the sound source by summing the frequency responses of the electrical signals with respect to each one of the plurality of subbands; and reproducing, based on the estimated frequency spectrum, the sound source, wherein the reproduced sound source is an enhanced version of the sound source.

7. The method of claim 6, further comprising:

prior to applying the respective one of the plurality of linearly-constrained minimum variance filters, calculating a short-time Fourier transform of the respective one of the electrical signals; and calculating an inverse short-time Fourier transform of the estimated frequency spectrum of the sound to generate an estimate of a source of the sound.

8. The method of claim 6, wherein the differential microphone array is one of a uniform linear microphone array or a non-uniform linear microphone array.

9. The method of claim 6, wherein the steering matrix D is a rectangular matrix, and wherein the steering matrix $D=[d^H(\omega, 1), d^H(\omega, \alpha_{N,1}), \ldots, d^H(\omega, \alpha_{N,N})]^T$, wherein N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]$, wherein $\alpha_{N,n}$ specifies angular locations of nulls, n=1, 2, . . . , N, $j=\sqrt{-1}$, ω represents angular frequency, $\tau_0=\delta/c$, wherein δ represents an inter-sensor distance, and c represents sound speed.

10. The method of claim 9, wherein the plurality of linearly-constrained minimum variance filters are minimum-norm filters represented by $h(\omega, \alpha)=D^H(\omega, \alpha)[D(\omega, \alpha)D^H(\omega, \alpha)]^{-1}\beta$, where β is a vector specifying a target beam pattern.

11. A non-transitory machine-readable storage medium having stored thereon instructions that, when executed, cause a processor to operate a differential microphone array that comprises a number (M) of microphone sensors to convert sound signals, originated from a sound source and received by the number (M) of microphones, to a number of electrical signals, the processor to:

specify a target differential order (N) for the differential microphone array, wherein M>N+1;

construct, by the processor, a steering matrix D comprising N+1 steering vectors;

calculate a respective one of a plurality of linearly-constrained minimum variance filters based on the steering matrix;

apply the respective one of the plurality of linearly-constrained minimum variance filters to a respective one of the electrical signals to calculate a respective frequency response of the electrical signals, wherein the respective frequency response comprises a plurality of components associated with a plurality of subbands;

calculate an estimated frequency spectrum of the sound source by summing the frequency responses of the electrical signals with respect to each one of the plurality of subbands; and reproduce, based on the estimated frequency spectrum, the sound source, wherein the reproduced sound source is an enhanced version of the sound source.

12. The non-transitory machine-readable storage medium of claim 11, wherein the processor is further to:

prior to applying the respective one of the plurality of linearly-constrained minimum variance filters, calculate a short-time Fourier transform of the respective one of the electrical signals; and calculate an inverse short-time Fourier transform of the estimated frequency spectrum of the sound to generate an estimate of a source of the sound.

13. The non-transitory machine-readable storage medium of claim 11, wherein the differential microphone array is one of a uniform linear microphone array or a non-uniform linear microphone array.

14. The non-transitory machine-readable storage medium of claim 11, wherein the steering matrix D is a rectangular matrix, and wherein the steering matrix $D=[d^H(\omega, 1), d^H(\omega, \alpha_{N,1}), \ldots, d^H(\omega, \alpha_{N,N})]^T$, wherein N+1 steering vectors $d(\omega, \alpha_{N,n})=[1, e^{-j\omega\tau_0\alpha_{N,n}}, \ldots, e^{-j(M-1)\omega\tau_0\alpha_{N,n}}]$, wherein $\alpha_{N,n}$, specifies angular locations of nulls, n=1, 2, . . . , N, $j=\sqrt{-1}$, $\omega$ represents angular frequency, $\tau_0=\delta/c$, wherein $\delta$ represents an inter-sensor distance, and c represents sound speed.

15. The non-transitory machine-readable storage medium of claim 14, wherein the plurality of linearly-constrained minimum variance filters are minimum-norm filters represented by $h(\omega, \alpha)=D^H(\omega, \alpha)[D(\omega, \alpha)D^H(\omega, \alpha)]^{-1}\beta$, where $\beta$ is a vector specifying a target beam pattern.

* * * * *